United States Patent [19]

McKee et al.

[11] Patent Number: 4,604,070

[45] Date of Patent: Aug. 5, 1986

[54] SKI BOARD HAVING ANGULARLY ADJUSTABLE BINDING

[76] Inventors: Bruce C. McKee; Mitchell S. Ross, both of 65 Bungan Head Road, Newport, New South Wales 2106, Australia

[21] Appl. No.: 807,202

[22] Filed: Dec. 10, 1985

Related U.S. Application Data

[63] Continuation of Ser. No. 573,953, Jan. 25, 1984, abandoned.

[30] Foreign Application Priority Data

Jan. 28, 1983 [AU] Australia ..... PF7824

[51] Int. Cl.[4] ..... A63C 15/06

[52] U.S. Cl. ..... 441/70; 441/75

[58] Field of Search ..... 441/65–75, 441/79; 114/39.2, 93, 253

[56] References Cited

U.S. PATENT DOCUMENTS

| | | | |
|---|---|---|---|
| 2,327,783 | 8/1943 | Hains | 441/70 |
| 2,664,578 | 1/1954 | Clinedinst | 441/70 |
| 3,404,900 | 10/1968 | Rippetoe | 441/70 |
| 3,564,632 | 2/1971 | Bahne | 441/79 |
| 3,593,356 | 7/1971 | Schmalfeldt | 441/74 |
| 3,802,374 | 4/1974 | Brown | 114/254 |
| 3,900,204 | 8/1975 | Weber | 280/11.13 S |
| 4,405,139 | 9/1983 | Kawahard | 441/79 |
| 4,466,373 | 8/1984 | Prade et al. | 441/70 |

FOREIGN PATENT DOCUMENTS

| | | | |
|---|---|---|---|
| 18647 | 2/1972 | Australia | 441/74 |
| 3116179 | 11/1982 | Fed. Rep. of Germany | 441/75 |
| 8218556 | 11/1982 | Fed. Rep. of Germany | 114/39.2 |
| 2250551 | 6/1975 | France | 441/74 |
| 2287251 | 5/1976 | France | 441/70 |

*Primary Examiner*—Trygve M. Blix
*Assistant Examiner*—Stephen P. Avila
*Attorney, Agent, or Firm*—Fitch, Even, Tabin & Flannery

[57] ABSTRACT

A water ski board having two feet engaging assemblies which allow a user of the board to orient his feet so as to extend generally transversely of the board.

9 Claims, 14 Drawing Figures

SKI BOARD HAVING ANGULARLY ADJUSTABLE BINDING

This application is a continuation of application Ser. No. 573,953 filed Jan. 25, 1984, now abandoned.

The present invention relates to skis and more particularly but not exclusively to water skis.

It has been found that conventional surf boards are usable behind a boat for water skiing, however the use of such surf boards is generally difficult due to the size of the board and the fact that the boards are not provided with means for gripping the feet of the rider. Additionally known grips employed on water skis have suffered from one major disadvantage in that they are not easily adjusted so as to securely attach the feet of the user to the ski. Also they are not suitable for a ski board.

It is the object of the present invention to overcome or substantially ameliorate the above disadvantages.

There is disclosed herein a ski board comprising an elongated ski body having an upper surface upon which a rider stands in use of the board, a first foot engaging means located generally centrally of said surface and adapted to receive a foot of the rider so that the foot extends at least partly transverse of the body, and a second foot engaging means rearward of said first foot engaging means and adapted to engage the other foot of the rider so that said other foot extends at least partly transverse of said body.

A preferred form of the present invention will now be described by way of example with reference to the accompanying drawings wherein.

Figure 1:
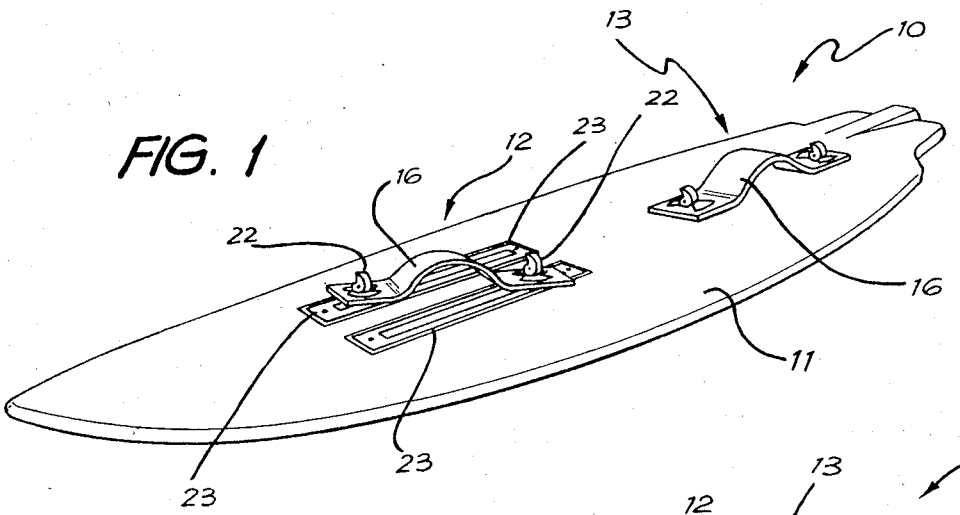
FIG. 1 is a schematic perspective view of a water ski board.
Figure 2:
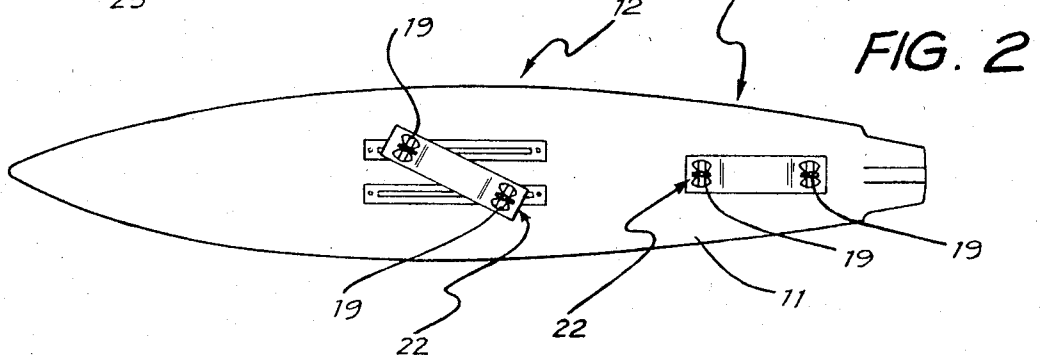
FIG. 2 is a schematic plan view of the water ski board of FIG. 1.
Figure 3:
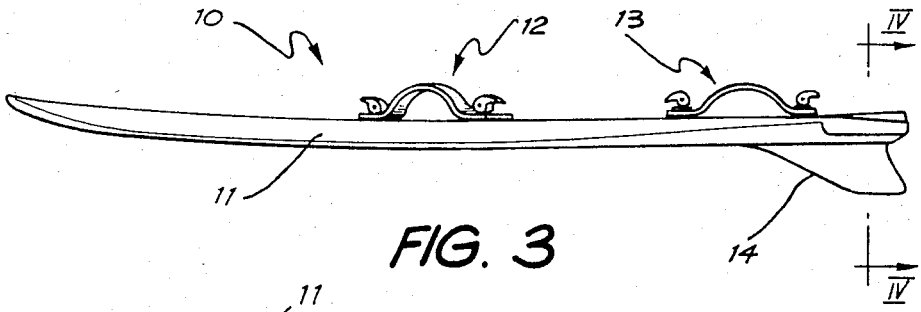
FIG. 3 is a schematic side elevation of the water ski board of FIG. 1.
Figure 4:
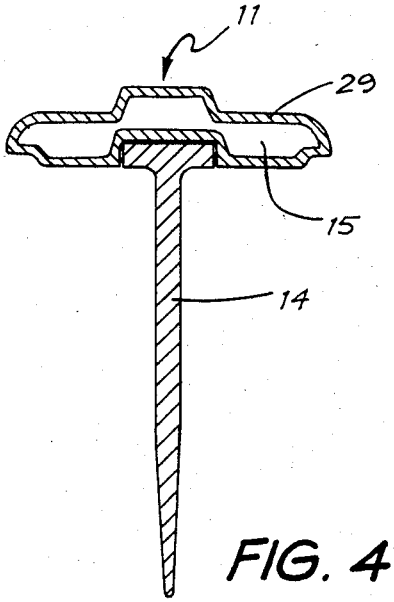
Figure 5:
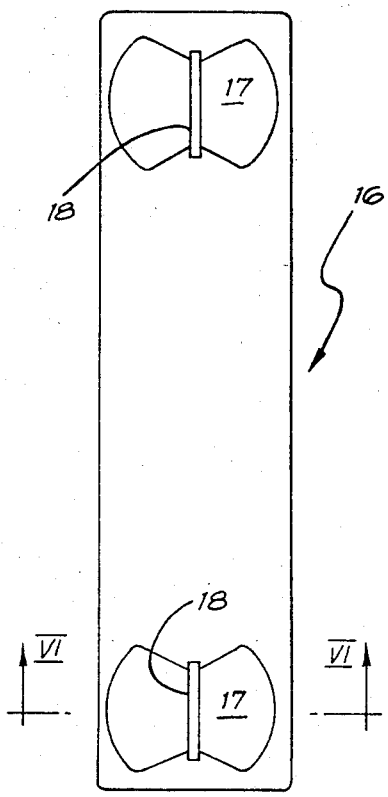
Figure 6:
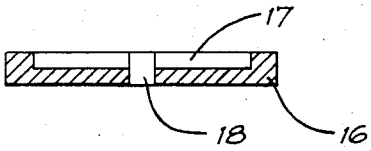
Figure 7:
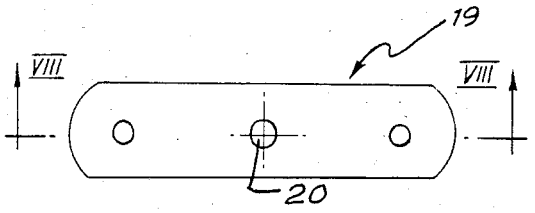
Figure 8:
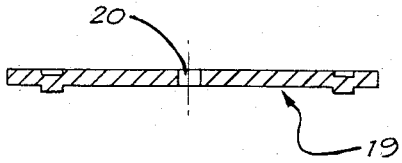
Figure 9:
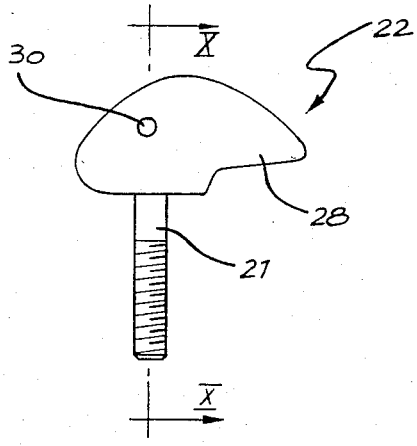
Figure 10:
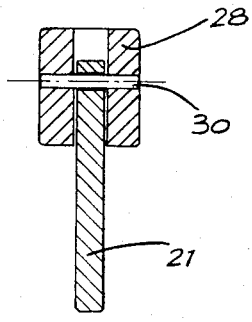
Figure 11:
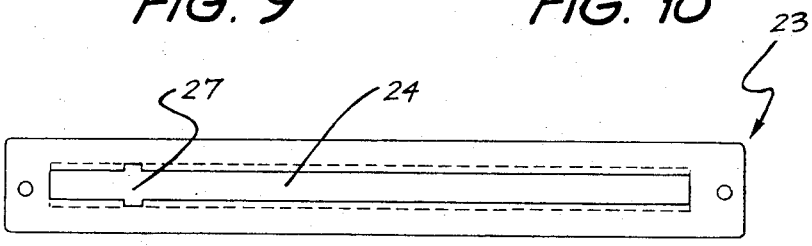
Figure 12:
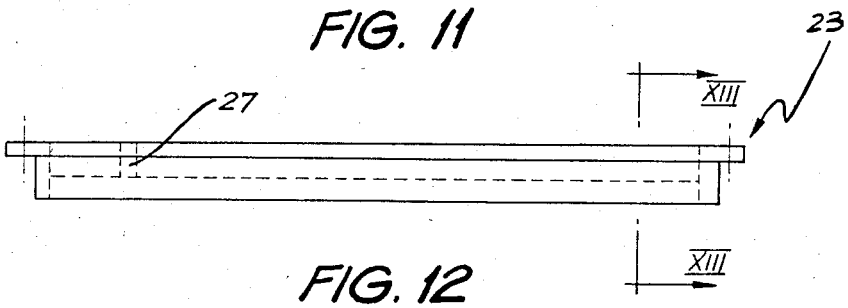
Figure 13:
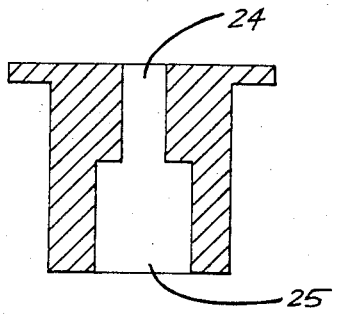
Figure 14:
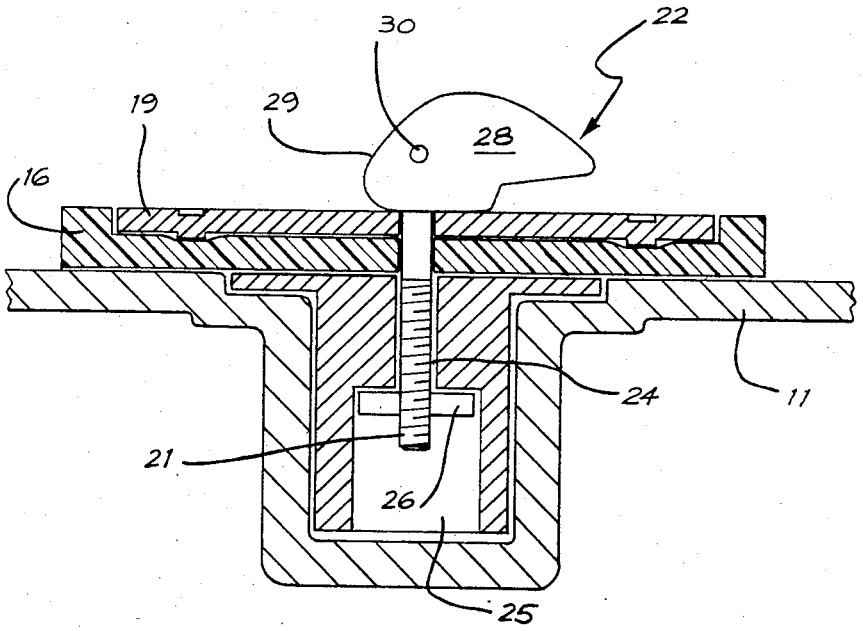

FIG. 4 is a schematic sectioned end elevation of the ski board of FIG. 1 sectioned along the line 4—4, FIG. 5 is a schematic plan view of a resilient strap employed on the ski board of FIG. 1, FIG. 6 is a schematic end elevation of the strap of FIG. 5 sectioned along the line 6—6, FIG. 7 is a schematic plan view of a plate employed to fix the strap of FIG. 5 to the body of the ski board of FIG. 1, FIG. 8 is a schematic sectioned side elevation of the plate of FIG. 7 sectioned along the line 8—8, FIG. 9 is a schematic side elevation of a clamp member employed to secure the plate of FIG. 7 to the body of the water ski board of FIG. 1, FIG. 10 is a schematic sectioned end elevation of the clamp member of FIG. 9, FIG. 11 is a schematic plan view of a base to receive a portion of the clamp member of FIG. 9, FIG. 12 is a schematic side elevation of the base of FIG. 11, FIG. 13 is a schematic sectioned end elevation of the base of FIG. 12 sectioned along the line 13—13, and FIG. 14 is a schematic sectioned end elevation of the plate, strap, clamp member and base assembled.

In FIG. 1 there is schematically depicted a ski board 10 adapted for use behind a boat so as to be used as a water ski board. The ski board 10 includes a body 11 to which is attached two foot engaging assemblies 12 and 13. The assembly 12 is adapted to receive the forward most foot of a rider of the ski board 10 so that the riders foot can extend at least partly transverse of the body 11. The assembly 13 is adapted to receive the other foot of the rider so that this other foot will extend also generally transverse of the ski board 10. Attached to the bottom surface of the body 11 is a removable fin 14 which aids in giving the ski board 10 direction. Additionally, by removing the fin 14, the board 10 may be used in snow for skiing. It should also be appreciated that the body 11 is formed of a shell 29 of molded plastics material defining a cavity into which a foam material is injected to give the ski board 10 buoyancy. The assembly 12 includes a flexible strap 16, more fully depicted in FIGS. 5 and 6, which strap 16 is formed of resilient materials such as plastics or rubber. The strap 16 is deformed in use so as to provide a cavity adjacent the body 11 to receive the foot of the rider. The strap 16 is provided with two recessed apportions 17 through which passes slot 18. The recessed apportions 17 are adapted to receive the plate 19 of FIGS. 7 and 8 with the recessed apportions 17 being fan shaped to allow pivoting motion of the plate 19 relative to the strap 16 to thereby adjust the angle of the strap 16 relative to the longitudinal axis of the board 10 and to shape the loop provided by the strap 16. The plate 19 includes a central passage 20 through which shaft 21 of the clamp member 22 passes. The shaft 21 is threaded so as to receive a nut to thereby secure the clamp member 22 to a base 23 fixed to the top surface of the body 11. The base 23 is generally a channel member having a generally central narrow slot 24 through which the shaft 21 passes. The slot 24 communicates with a wider slot 25 which receives a nut 26 which threadably engages the shaft 21. Additionally the base 23 is provided with a transverse slot 27 to enable location of the nut 26 in the slot 25.

In operation of the above ski board 10, the strap 16 is held in position by being sandwiched against the body 11 by means of the plate 19. The plate 19 is forced towards the body 11 by means of the clamp member 22. The clamp member 22 includes a head 28 which has a cam face 29 which is brought into engagement with the plate in order to clamp the plate 19 against the strap 16. The head 28 is pivotally attached to the shaft 21 by a pin 30, and is rotated to clamp against the plate 19.

The assembly 13 also includes a strap 16 and is fastened to the body 11 by two further plates 19 so that the position of the strap 16 may be adjusted. Additionally the plate 19 would be forced into engagement with the strap 16 by means of a clamp member 22.

A particular advantage of the above described preferred embodiment is that the front strap 16 is angularly adjustable relative to the longitudinal axis of the board. i.e. the front strap 16 can define a loop, to receive a foot of the user, which loop can at least partly be adjusted so as to face transversly of the board body 11.

Still further there is provided an easily operated and quick means of adjustably attaching the straps 16 to the body 11. More particularly, the clamp members 22 are far easier and more quickly operated than conventional means for securing foot straps to wate skis. Accordingly the assembly 12 could be used with a conventional water ski.

What we claim is:

1. A ski board comprising an elongated ski body having an upper surface upon which a rider stands in use of the board, a first foot engaging means located generally centrally of the said surface and adapted to receive a foot of the rider so that the foot extends at least partly transverse of said surface; a second foot engaging means rearward of said first foot engaging means and adapted to engage the other foot of the rider so that said other foot extends at least partly transverse of said surface; each engaging means including an elongated flexible strap; first and second securing means attaching the ends of each strap to said surface at spaced locations so that the straps form loops within which the user's feet are located; and wherein the first securing means adjustably attaches the ends of the strap of said first securing means to said surface at locations spaced transversely of the board, with the ends of the strap of said first securing means being movably attached to said surface, the angle of the strap being independently movably adjustable relative to the longitudinal axis of the board to enable the user's foot engaged therein to be angularly adjustable as it extends generally transverse of the board.

2. The ski board of claim 1 wherein the ends of the strap of said second foot engaging means are fixed at positions generally centrally transverse of the board and are located at longitudinally spaced locations on said surface.

3. The ski board of claim 1 or 2 wherein each securing means enables rotation of the end of the strap associated therewith so that each strap is resiliently deformable to further enhance accommodation of the user's foot therein.

4. The ski board of claims 3 wherein the end of each strap is provided with a dovetail recess and each securing means includes a clamp member angularly movable within said recess to enable rotation of the end of each strap.

5. The ski board of claim 1 wherein the securing means for said first foot engaging means includes two channel members fixed to the upper surface of the board so as to extend generally longitudinally thereof, the strap of said first foot engaging means having a hole at each end to be aligned with said channel members, two clamp plates to abut the strap of said first foot engaging means and each having a hole to be aligned with a respective hole of the strap of said first foot engaging means, a retaining member captively located within each channel member but movable longitudinally thereof, a retaining shaft for each retaining member adapted to have one end securely engaged with same, each retaining shaft extending through the strap of said first foot engaging means and clamp plate to engage said retaining means, and a rotatable cam member mounted on the other end of said retaining shaft, each cam member being rotatable from a position sandwiching said strap between said plate and a respective one of said channel members to thereby fix the strap relative to said channel member, to a further position allowing movement of the strap longitudinally of said channel member to thereby provide adjustment of the strap in use relative to the board.

6. The ski board of claim 5 wherein said retaining member is a threaded nut and said retaining shaft has a further portion to engage said nut.

7. A ski board comprising an elongated ski body having an upper surface upon which a rider stands in use of the board, a first foot engaging means located generally centrally of the said surface and adapted to receive a foot of the rider so that the foot extends at least partly transverse of said surface; a second foot engaging means rearward of said first foot engaging means and adapted to engage the other foot of the rider so that said other foot extends at least partly transverse of said surface; each engaging means including an elongated flexible strap; first and second securing means attaching the ends of each strap to said surface at spaced locations so that the straps form loops within which the user's feet are located; and wherein the first securing means adjustably attaches the ends of the strap of said first securing means to said surface at locations spaced transversely of the board, with the ends of the strap of said first securing means being movably attached to said surface so as to be independently movably adjustable longitudinal of the board to enable the user's foot engaged therein to be positioned so as to extend generally transverse of the board, the ends of the strap of said second foot engaging means being fixed at positions generally centrally transverse of the board and being located at longitudinally spaced locations on said surface, each securing means enabling rotation of the end of the strap associated therewith so that each strap is resiliently deformable to further enhance accommodation of the user's foot therein, and the end of each strap being provided with a dovetail recess and each securing means including a clamp member angularly movable within said recess to enable rotation of the end of each strap.

8. A ski board comprising an elongated ski body having an upper surface upon which a rider stands in use of the board, a first foot engaging means located generally centrally of the said surface and adapted to receive a foot of the rider so that the foot extends at least partly transverse of said surface; a second foot engaging means rearward of said first foot engaging means and adapted to engage the other foot of the rider so that said other foot extends at least partly transverse of said surface; each engaging means including an elongated flexible strap; first and second securing means attaching the ends of each strap to said surface at spaced locations so that the straps form loops within which the user's feet are located; and wherein the first securing means adjustably attaches the ends of the strap of said first securing means to said surface at locations spaced transversely of the board, with the ends of the strap of said first securing means being movably attached to said surface so as to be independently movably adjustable longitudinal of the board to enable the user's foot engaged therein to be positioned so as to extend generally transverse of the board, the securing means for said first foot engaging means including two channel members fixed to the upper surface of the board so as to extend generally longitudinally thereof, the strap of said first foot engaging means having a hole at each end to be aligned with said channel members, two clamp plates to abut the strap of said first foot engaging means and each having a hole to be aligned with a respective hole of the strap of said first foot engaging means, a retaining member captively located within each channel member but movable longitudinally thereof, a retaining shaft for each retaining member adapted to have one end securely engaged with same, each retaining shaft extending through the strap of said first foot engaging means and clamp plate to engage said retaining means, and a rotatable cam member mounted on the other end of said retaining shaft, each cam member being rotatable from a position sandwiching said strap between said plate and a respective one of said channel members to thereby fix the strap relative to said channel member, to a further position allowing movement of the strap longitudinally of said channel member to thereby provide adjustment of the strap in use relative to the board.

9. The ski board of claim 8 wherein said retaining member is a threaded nut and said retaining shaft has a further portion to engage said nut.

* * * * *

UNITED STATES PATENT AND TRADEMARK OFFICE

CERTIFICATE OF CORRECTION

PATENT NO. : 4,604,070

DATED : August 5, 1986

INVENTOR(S) : McKee et al.

It is certified that error appears in the above-identified patent and that said Letters Patent is hereby corrected as shown below:

Col. 2, Line 11, after "cavity" insert --15--.
Col. 2, Line 42, after "plate" insert --19--.
Col. 2, Line 55, change " transversly" to --transversely--.
Col. 2, Line 60, change "wate" to --water--.
Col. 3, Line 28, change "claims" to --claim--.
Col. 4, Line 34, change "form" to --forms--.

Signed and Sealed this

Twenty-first Day of October, 1986

[SEAL]

*Attest:*

DONALD J. QUIGG

*Attesting Officer* *Commissioner of Patents and Trademarks*